US008967677B2

(12) United States Patent
Chen et al.

(10) Patent No.: US 8,967,677 B2
(45) Date of Patent: Mar. 3, 2015

(54) ANTI-INTRUSION LOCK

(76) Inventors: Te-Yu Chen, Pingtung (TW); Te Ming Chen, Pingtung (TW)

( * ) Notice: Subject to any disclaimer, the term of this patent is extended or adjusted under 35 U.S.C. 154(b) by 97 days.

(21) Appl. No.: 13/584,777

(22) Filed: Aug. 13, 2012

(65) Prior Publication Data

US 2014/0042757 A1 Feb. 13, 2014

(51) Int. Cl.
*E05C 1/12* (2006.01)

(52) U.S. Cl.
USPC ..... 292/169.14; 292/137; 292/138; 292/140

(58) Field of Classification Search
CPC . E05B 13/002; E05B 13/004; E05B 17/2007; E05B 17/2011; E05B 17/2015; E05B 17/2084; E05B 55/00
USPC ..... 70/107–111, 472, 486; 292/32, 34, 36, 292/37, 137, 138, 140, 163, 164, 165, 169, 292/169.13, 169.14, 170, 341.15
See application file for complete search history.

(56) References Cited

U.S. PATENT DOCUMENTS 4,674,776 A * 6/1987 James ..... 292/40
2004/0089033 A1* 5/2004 Lu ..... 70/107

* cited by examiner

*Primary Examiner* — Kristina Fulton
*Assistant Examiner* — Christine M Mills
(74) *Attorney, Agent, or Firm* — Leong C. Lei

(57) ABSTRACT

An anti-intrusion lock includes a sliding element at a handle shaft, a stop element under the handle shaft, wherein the stop element is suitable for moving upward or downward, a clamp button and a sliding lever connected to the clamp button, wherein the clamp button is led to be exposed and protruded from a side of the lock. When the lock is locked, the clamp button is pressed down to drive the sliding lever to push the stop element upward such that the stop element is stopped at the handle shaft. Thereby, when a thief turns the handle shaft, only the sliding element is driven to move along a sliding groove set at the lock such that the lock pretends to open and the thief misunderstands the lock has been broken and gives up intruding.

5 Claims, 7 Drawing Sheets

ANTI-INTRUSION LOCK

BACKGROUND OF THE DISCLOSURE a) Field of the Disclosure

The invention relates to an anti-intrusion lock, and more particularly, to an anti-intrusion lock pretending to open when being locked such that a thief misunderstands the lock has been broken and gives up intruding. Accordingly, protection from thieves can be achieved.

b) Brief Description of the Related Art

A user when going out generally uses a key to lock. Accordingly, once intending to intrude illegally, a thief usually uses an unlocking tool to turn on a lock core and then turn a handle shaft so as to open a lock. If the lock is well designed so as not to be easily turned on immediately, most thieves force the handle shaft to be turned, causing the lock to be broken and incapable of being locked. Thus, the traditional lock cannot prevent the thieves from intrusion and the lock is possibly broken. The inventors had long experience in this field and straight did researches and tests, and finally an anti-intrusion device is improved to lead a thief to misunderstand the lock has been broken and to give up intruding.

SUMMARY OF THE DISCLOSURE

In accordance with an objective of the present invention, an anti-intrusion lock is provided to pretend to open by easy operation when being locked such that a thief misunderstands the lock has been broken and gives up intruding.

The anti-intrusion lock includes a sliding element at a handle shaft, a stop element under the handle shaft, wherein the stop element is suitable for moving upward or downward, a clamp button and a sliding lever connected to the clamp button, wherein the clamp button is led to be exposed and protruded from a side of the lock. When the lock is locked, the clamp button is pressed down to drive the sliding lever to push the stop element upward such that the stop element is stopped at the handle shaft. Thereby, when a thief turns the handle shaft, only the sliding element is driven to move along a sliding groove set at the lock such that the lock pretends to open and the thief misunderstands the lock has been broken and gives up intruding.

In accordance with the anti-intrusion lock, the clamp button moves with a stop via a swing element, wherein the stop lever is connected to the sliding lever via a connecting part. When the connecting part is detached, the lock can be recovered to have general locking functions.

The accompanying drawings are included to provide a further understanding of the invention, and are incorporated as a part of this specification. The drawings illustrate embodiments of the invention and, together with the description, serve to explain the principles of the invention.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it refers to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure.

Figure 1:
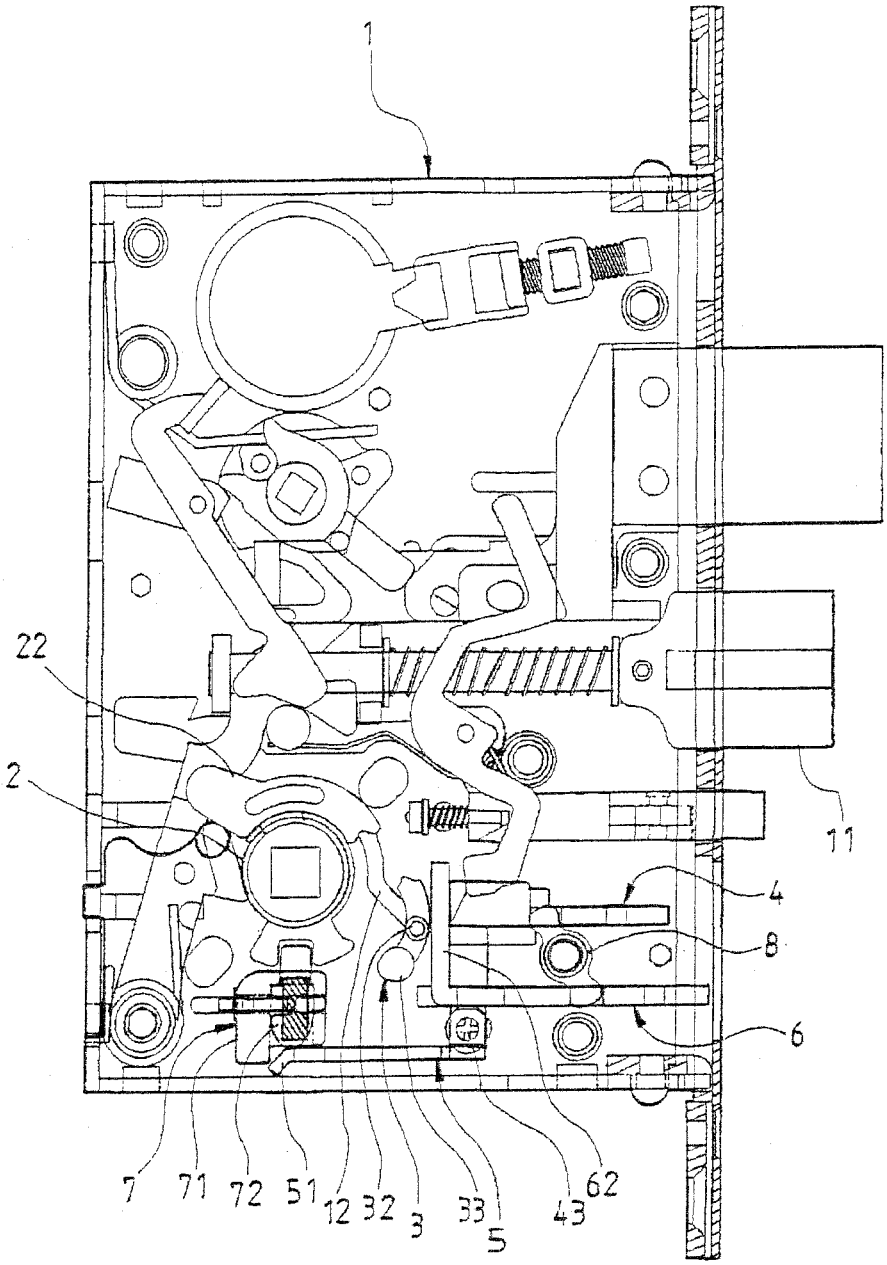
FIG. 1 is a structural view in accordance with the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

Figure 2:
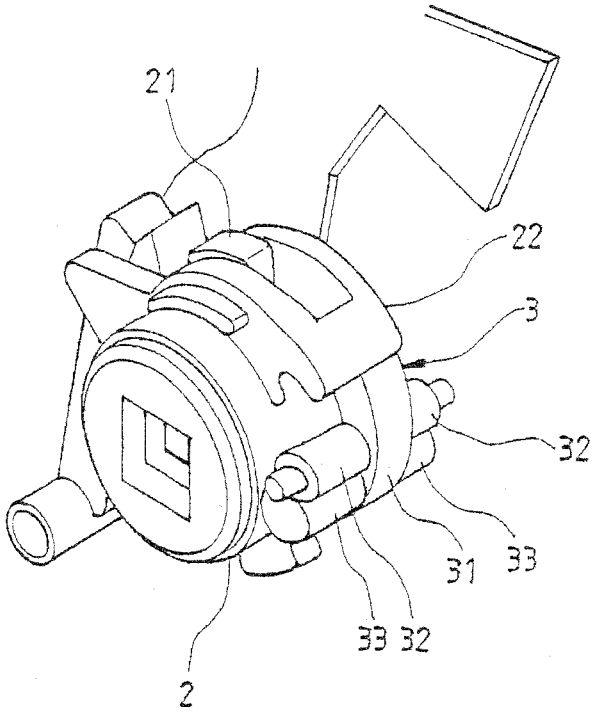
FIG. 2 is a three dimensional view of a shaft in accordance with the present invention.
Figure 3:
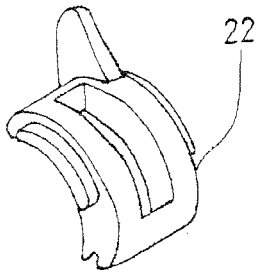
FIG. 3 is a three dimensional view of a sliding block of a handle shaft in accordance with the present invention.
Figure 4:
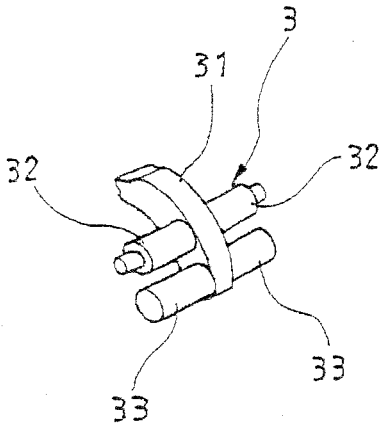
FIG. 4 is a three dimensional view of a sliding element in accordance with the present invention.
Figure 5:
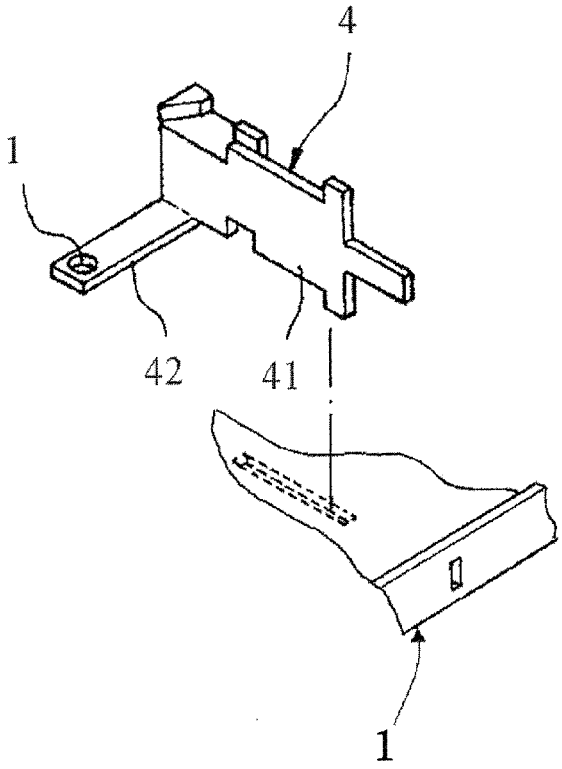
FIG. 5 is a three dimensional view of a clamp button in accordance with the present invention.
Figure 6:
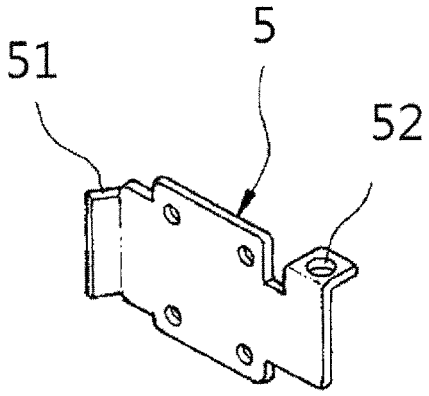
FIG. 6 is a three dimensional view of a sliding lever in accordance with the present invention.
Figure 7:
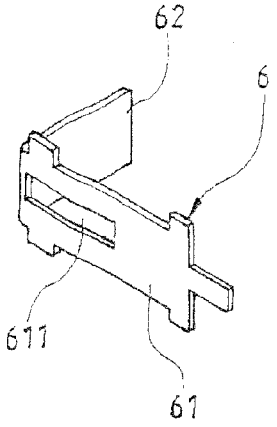
FIG. 7 is a three dimensional view of a stop lever in accordance with the present invention.
Figure 8:
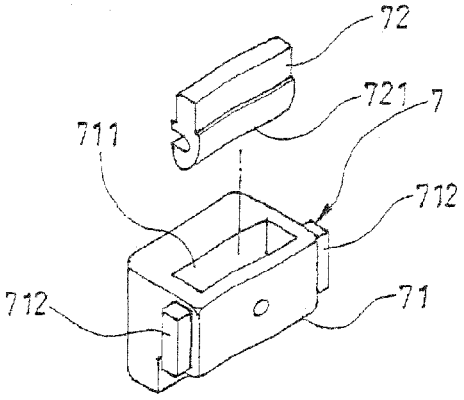
FIG. 8 is a three dimensional view of a stop element in accordance with the present invention.

FIG. 1 is a structural view in accordance with the present invention. FIG. 2 is a three dimensional view of a shaft in accordance with the present invention. FIG. 3 is a three dimensional view of a sliding block of a handle shaft in accordance with the present invention. FIG. 4 is a three dimensional view of a sliding element in accordance with the present invention. FIG. 5 is a three dimensional view of a clamp button in accordance with the present invention. FIG. 6 is a three dimensional view of a sliding lever in accordance with the present invention. FIG. 7 is a three dimensional view of a stop lever in accordance with the present invention. FIG. 8 is a three dimensional view of a stop element in accordance with the present invention. Referring to FIGS. 1-8, in accordance with the present invention, in a lock 1 is a traditional strike plate 11 suitable for extending outside in a lock state or retracting in an unlock state, controlled by turning of a handle shaft 2. The lock 1 includes a sliding element 3, a clamp button 4, a sliding lever 5, a stop lever 6 and a stop element 7. A protruding pin 21 set on a top edge of the handle shaft 2 passes through a sliding member 22 driving the strike plate 11 to move horizontally. A gap 23 is at a bottom of the handle shaft 2.

The sliding element 3 mounted at the handle shaft 2 includes an arc-shaped strip 31, positioning pins 32 at centers of two sides of the strip 31 and pins 33 at a bottom edge of the strip 31. The positioning pins 32 pass through sliding grooves 12 arranged at the lock 1 such that the sliding element 3 can move along the sliding grooves 12.

The clamp button 4 includes a horizontal portion 41 having a front end exposed and protruded from the lock 1 and a vertical portion 42 bent in a right angle at a distal end of the horizontal portion 41. A fixing hole 421 is set at the vertical portion 42. The horizontal portion 41 is led to move horizontally along a sliding groove, not shown in Figures, and has a surface against an end of a swing element 8.

The sliding lever 5 has a withstanding portion 51 bent at an end of the sliding lever 5. A fixing hole 52 is at another end of the sliding lever 5. The sliding lever 5 connects with the clamp button 4 by a connecting part 43 fixing with the fixing holes 52 at the sliding lever 5 and the fixing hole 421 at the clamp button 4.

The stop lever 6 is provided with a plate 61 having a front end exposed and protruded from the lock 1. A hole 611 at the plate 61 is set for receiving the other end of the swing element 8. The plate 61 has a stop portion 62 bent in a right angle at a distal end of the plate 61.

The stop element 7 includes a pedestal 71 and a sliding block 72 received in the pedestal 71. A receiving groove 711 is provided in the pedestal 71. The stop element 7 has ribs 712 arranged respectively at two sides of the pedestal 71. The sliding block 72 has a round protruding portion 721 at a bottom edge of the sliding block 72 and is suitable for sliding upward and downward along the receiving groove 711 in the pedestal 71.

The above-mentioned elements can compose an anti-intrusion lock. When the lock 1 is in a lock state, the clamp button 4 is pressed down to drive the sliding lever 5 to push the sliding block 72 of the stop element 7 upward such that the sliding block 72 is stopped at the gap 23 in the handle shaft 2. The withstanding portion 51 of the sliding lever 5 has a bent shape and the round protruding portion 721 is arranged at a bottom of the sliding block 72. Thus, it is beneficial to the sliding lever 5 withstanding the sliding block 72. Thereby, when a thief turns the handle shaft 2, only the sliding element 3 is driven to move along the sliding groove 12 set at the lock 1 such that the lock 1 pretends to open and the thief misunderstands the lock 1 has been broken and gives up intruding.

Figure 9:
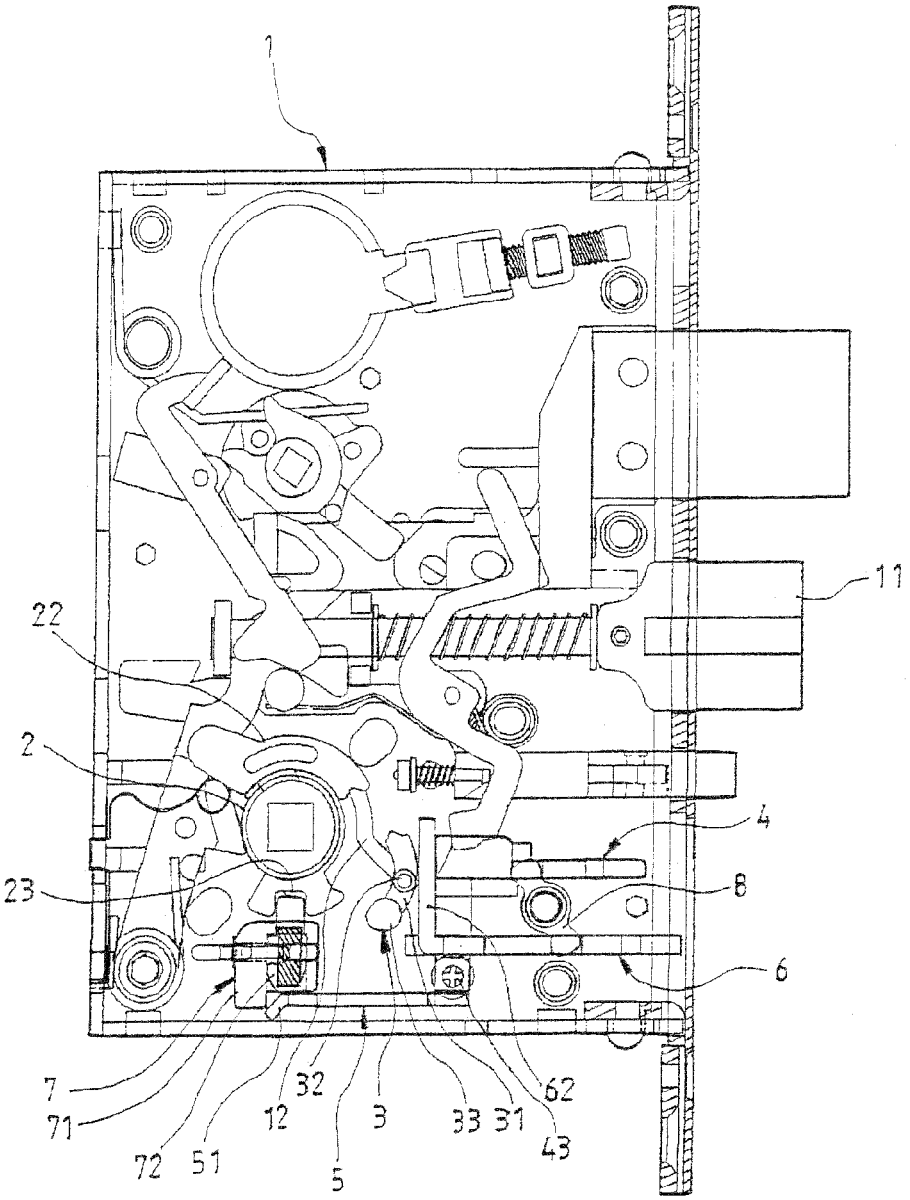
FIG. 9 shows a lock state in accordance with the present invention.

FIG. 9 shows a lock state in accordance with the present invention. Referring to FIG. 9, when the lock 1 is in the lock state, the clamp button 4 is pressed down to draw the stop lever 6 outward by means of the linkage of the swing element 8. The stop portion 62 of the stop lever 6 is led to move in a distance and is not stopped at the sliding groove 12. At the same time, the clamp button 4 drives the sliding lever 5 to have the withstanding portion 51 at the distal end of the sliding lever 5 withstand the sliding block 72 of the stop element 7 to be pushed upward and stopped at the gap 23 at the handle shaft 2. Thereby, when a thief turns the handle shaft 2, only the sliding element 3 is driven to move along the sliding groove 12 set at the lock 1 such that the lock 1 pretends to open, that is, a handle is idly turned in a specific angle, and the thief misunderstands the lock 1 has been broken and gives up intruding.

Figure 10:
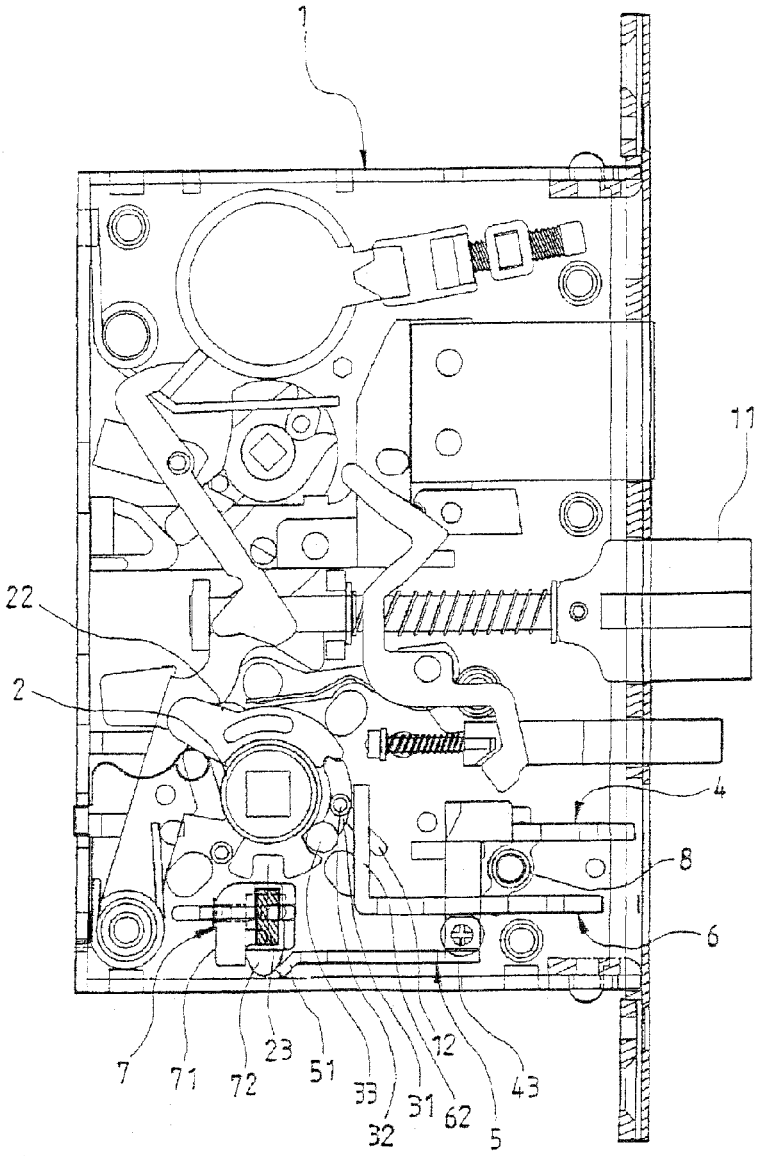
FIG. 10 shows an unlock state in accordance with the present invention.

FIG. 10 shows an unlock state in accordance with the present invention. Referring to FIG. 10, when the stop lever 6 is pressed, the clamp button 4 is drawn outward by means of the linkage of the swing element 8. The stop portion 62 of the stop lever 6 is led to move in a distance and is then stopped at the sliding groove 12. At the same time, the clamp button 4 drives the sliding lever 5 to depart from the sliding block 72 such that the sliding block 72 moves downward and departs from the gap 23 at the handle shaft 2. When the handle shaft 2 is turned, the sliding element 3 is stopped by the stop portion 62 and an openable state is recovered, that is, the handle can be turned in a complete angle.

The above-mentioned clamp button 4 and sliding lever 5 is connected to each other through the connecting part 43. However, when the function of the anti-intrusion is not used, the connecting part 43 can be detached and a general lock function can be recovered.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. An anti-intrusion device comprising:

a lock comprising a handle shaft and a strike plate, wherein a protruding pin on a top edge of the handle shaft passes through a sliding member driving the strike plate to move horizontally so as to keep the lock in a lock or unlock state, wherein a gap is at a bottom of the handle shaft;

a sliding element at the handle shaft, wherein the sliding element comprises an arc-shaped strip, a positioning pin at a center of two sides of the strip and a pin at a bottom edge of the strip, wherein the positioning pin passes through a sliding groove at the lock such that the sliding element is suitable for moving along the sliding groove;

a clamp button comprising a horizontal portion having a front end exposed and protruded from the lock and a vertical portion bent in a right angle at a distal end of the horizontal portion, wherein a fixing hole is at the vertical portion, wherein when the clamp button is pressed, the horizontal portion of the clamp button is led to move horizontally at the lock;

a sliding lever comprising a withstanding portion bent at an end of the sliding lever, wherein a fixing hole is at another end of the sliding lever, wherein the sliding lever connects with the clamp button by a connecting part fixing with the fixing holes at the sliding lever and the fixing hole at the clamp button;

a stop lever suitable for moving with the clamp button, wherein the stop lever comprises a plate having a front end exposed and protruded from the lock and a stop portion bent in a right angle at a distal end of the plate; and a stop element comprising a pedestal and a sliding block received in the pedestal, wherein the sliding block is suitable for sliding upward and downward along the pedestal, wherein when the lock is in a lock state, the clamp button is pressed down to drive the sliding lever to push the sliding block of the stop element upward such that the sliding block is stopped at the gap at the handle shaft, wherein when a thief turns the handle shaft, only the sliding element is driven to move along the sliding groove at the lock such that the lock pretends to open and the thief misunderstands the lock has been broken and gives up intruding.

2. The anti-intrusion device of claim 1, wherein a hole at the plate of the stop lever receives an end of a swing element, wherein the swing element has another end against a surface of the clamp button such that the stop lever moves with the clamp button.

3. The anti-intrusion device of claim 1, wherein a receiving groove in the pedestal of the stop element receives the sliding block such that the sliding block is suitable for moving upward or downward along the receiving groove.

4. The anti-intrusion device of claim 3, wherein the stop element has ribs arranged respectively at two sides of the pedestal of the stop element and positioned at the lock.

5. The anti-intrusion device of claim 3, wherein the sliding block has a round protruding portion at a bottom edge of the sliding block and is suitable for being withstood by the sliding lever.

* * * * *